US009198231B2

(12) United States Patent
Nagasaka et al.

(10) Patent No.: US 9,198,231 B2
(45) Date of Patent: Nov. 24, 2015

(54) HEATER CONTROL DEVICE, METHOD AND PROGRAM

(75) Inventors: Keiji Nagasaka, Tokyo (JP); Hidetaka Sato, Tokyo (JP); Koji Nakano, Tokyo (JP); Shiro Matsubara, Tokyo (JP); Satoshi Kominami, Tokyo (JP); Kiyotaka Sumito, Tokyo (JP); Kenji Shimizu, Tokyo (JP)

(73) Assignee: MITSUBISHI HEAVY INDUSTRIES AUTOMOTIVE THERMAL SYSTEMS CO., LTD., Kiyosu-shi (JP)

( * ) Notice: Subject to any disclaimer, the term of this patent is extended or adjusted under 35 U.S.C. 154(b) by 143 days.

(21) Appl. No.: 14/002,923

(22) PCT Filed: Aug. 6, 2012

(86) PCT No.: PCT/JP2012/069968

§ 371 (c)(1),
(2), (4) Date: Sep. 3, 2013

(87) PCT Pub. No.: WO2013/018919

PCT Pub. Date: Feb. 7, 2013

(65) Prior Publication Data

US 2013/0341318 A1 Dec. 26, 2013

(30) Foreign Application Priority Data

Aug. 4, 2011 (JP) ..... 2011-171154

(51) Int. Cl.
*H05B 1/02* (2006.01)

(52) U.S. Cl.
CPC ..... *H05B 1/0202* (2013.01); *H05B 1/0236* (2013.01); *H05B 2203/02* (2013.01)

(58) Field of Classification Search
CPC ..... H05B 1/0202; H05B 1/0236; H05B 2203/02; H05B 3/12; H05B 3/0042
USPC ..... 219/483, 485, 202, 208, 504, 505, 219/507–509
See application file for complete search history.

(56) References Cited

U.S. PATENT DOCUMENTS 3,953,711 A * 4/1976 Eck et al. ..... 219/458.1
5,789,723 A 8/1998 Hirst (Continued)

FOREIGN PATENT DOCUMENTS

CN 201166434 Y 12/2008
CN 101434184 A 5/2009

(Continued)

OTHER PUBLICATIONS

Chinese Office Action dated Jan. 12, 2015, issued in corresponding CN Patent Application No. 201280011789.X with English translation (20 pages).

(Continued)

*Primary Examiner* — Mark Paschall
(74) *Attorney, Agent, or Firm* — Westerman, Hattori, Daniels & Adrian, LLP

(57) ABSTRACT

A heater control device having at least two PTC heaters having PTC elements includes switching units which are provided so as to correspond to the PTC heaters and which switch an energized state and a non-energized state of the PTC elements by being turned ON and OFF, pattern information which defines state combination patterns of the energized state and the non-energized state of the PTC elements with respect to a required power value for the heater unit, and a ratio controlling unit which when the required power for the heater unit is at an intermediate value of the required power values defined in the pattern information, controls a ratio of the energized state to the non-energized state of the PTC elements based on a ratio of ON time to OFF time for which an average power within a certain period matches the required power.

7 Claims, 5 Drawing Sheets

(56) References Cited

U.S. PATENT DOCUMENTS

| | | | | |
|---|---|---|---|---|
| 7,200,327 | B2 * | 4/2007 | Pierron et al. | 392/350 |
| 7,902,806 | B2 * | 3/2011 | Yabe et al. | 323/288 |
| 8,890,039 | B2 * | 11/2014 | Etscheid et al. | 219/492 |
| 8,931,547 | B2 * | 1/2015 | Yen et al. | 165/202 |
| 2001/0040159 | A1 | 11/2001 | Jirmann | |
| 2011/0123180 | A1 | 5/2011 | Kakiuchi | |

FOREIGN PATENT DOCUMENTS

| | | | |
|---|---|---|---|
| DE | 10109734 | A1 | 9/2002 |
| DE | 102008056757 | A1 | 6/2009 |
| EP | 1091621 | A1 | 4/2001 |
| EP | 1416770 | A1 | 5/2004 |
| JP | 04-078413 | U | 7/1992 |
| JP | 10-111623 | A | 4/1998 |
| JP | 11-194840 | A | 7/1999 |
| JP | 11-249490 | A | 9/1999 |
| JP | 2000-225834 | A | 8/2000 |
| JP | 2000-347746 | A | 12/2000 |
| JP | 2003-050520 | A | 2/2003 |
| JP | 2003-217793 | A | 7/2003 |
| JP | 2006-185766 | A | 7/2006 |
| JP | 2007-115680 | A | 5/2007 |
| JP | 2007-283790 | A | 11/2007 |
| WO | 2010/004617 | A1 | 1/2010 |

OTHER PUBLICATIONS

Extended European Search Report dated Feb. 20, 2015, issued in corresponding EP Patent Application No. 12819393.5 with English translation (7 pages).

International Search Repot dated Aug. 28, 2012, issued in corresponding application No. PCT/JP2012/069968.

Written Opinion dated Aug. 28, 2012, issued in corresponding appilication No. PCT/JP2012/069968.

Notification of Reasons for Rejection dated May 12, 2015, issued in counterpart Japanese Patent Application No. 2011-171154, w/English translation (12 pages).

* cited by examiner

| PATTERN NUMBER | PTC HEATER OUTPUT POWER | PTC HEATER ON/OFF STATE (ON STATE: ● OFF STATE: ○) | | |
|---|---|---|---|---|
| | | PTC HEATER 2a | PTC HEATER 2b | PTC HEATER 2c |
| 0 | 0kW | ○ | ○ | ○ |
| 1 | 1kW | ○ | ● | ○ |
| 2 | 2kW | ● | ○ | ○ |
| 3 | 3kW | ● | ● | ○ |
| 4 | 4kW | ● | ○ | ● |
| 5 | 5kW | ● | ● | ● |

HEATER CONTROL DEVICE, METHOD AND PROGRAM

TECHNICAL FIELD

The present invention relates to a heater control device, method and program which are suitable for use in, for example, an in-vehicle PTC (Positive Temperature Coefficient) heater.

BACKGROUND ART

For example, PTC heaters which are one form of electric heaters have a structure in which heat is generated by energizing a PTC element which is a resistive element having a positive temperature coefficient by a DC power supply. PTC heaters are widely used because a resistance thereof rapidly increases as temperature increases at a certain timing and thus a constant temperature can be maintained by simple energization from the DC power supply, leading to a simple control structure (for example, PTL 1). Conventionally, PTC heaters are driven so as to satisfy a required power by controlling ON and OFF of a plurality of switching elements corresponding to the PTC heaters based on predefined combination information in which combinations of ON and OFF states of the switching elements are associated with output powers provided by the combinations.

CITATION LIST

Patent Literature

{PTL 1}
Japanese Unexamined Patent Application, Publication No. 2007-283790

SUMMARY OF INVENTION

Technical Problem

However, the problem with the conventional method is that power is applied by selecting a combination pattern with which an amount of output power closest to the required power is supplied among combination patterns of the output values defined by an ON state and an OFF state of the switching elements, it is only possible to supply an output power in a stepwise manner, and it is impossible to output an intermediate value of output power values defined by the combination patterns, which makes it impossible to perform fine control.

The present invention has been made in order to solve the above-described problem, and therefore has an object to provide a heater control device, method, and program which can perform fine control of output power values.

Solution to Problem

The present invention provides a heater control device to be applied to a heater unit which includes at least two PTC heaters having PTC elements, the heater control device including switching units which are provided so as to correspond to the PTC heaters and which switch between an energized state and a non-energized state of the PTC elements by being turned ON and OFF, pattern information which associates state combination patterns of the energized state and the non-energized state of the PTC elements and output power values supplied by the state combination patterns, and a ratio controlling unit which, when a required power for the heater unit is at an intermediate value of the output power values defined in the pattern information, controls a ratio of the energized state to the non-energized state of the PTC elements based on a ratio of ON time to OFF time for which an average power within a certain period matches the required power.

According to this configuration, the energized state and the non-energized state of the PTC elements are switched by controlling the switching units provided so as to correspond to the PTC heaters to be turned ON and OFF based on the pattern information in which state combination patterns of the energized state and the non-energized state of the PTC heaters and output power values supplied by the state combination patterns are defined, so that power which satisfies the required power can be output. Further, when the required power is at an intermediate value of the output power values defined in the pattern information, the PTC elements are controlled to be in an energized state only for a duration in a certain period during which the required power matches an average power within the certain period.

In this way, even when the required power is at an intermediate value of the output power values other than output power values which are defined in a stepwise manner in the pattern information, it is possible to finely control the power values output from the heater unit by controlling a ratio of ON time to OFF time.

The ratio controlling unit of the heater control device preferably controls the ratio so that a switching period of the switching units is longer than a period during which a switching loss caused by switching between the energized state and the non-energized state by the switching units is equal to or less than an allowable loss, and is shorter than a period determined according to the overall heat capacity of the heater unit while satisfying a condition that a difference between a water temperature of the PTC heaters and a target temperature is equal to or less than a predetermined temperature difference.

While control performance is better for a shorter period, because a surge current which is generated by a capacitance component existing in the PTC elements increases the switching loss, the period cannot be made extremely shorter. Further, when the period is too long, a temperature difference between the water temperature which is to be controlled and which rises and falls with respect to the target temperature and the target temperature becomes large, the period cannot be made extremely longer taking into account heat capacity of a system to be controlled. In order to address these matters, in the present invention, a switching period is made longer than a period during which a switching loss is equal to or less than an allowable loss and smaller than a period determined by the overall heat capacity of the heater unit while satisfying a condition that a difference between the water temperature of the PTC heaters and the target temperature is equal to or less than the predetermined temperature difference, so that it is possible to improve efficiency of the heater unit.

The above-described heater control device may calculate an actual power based on a present current value and a present voltage value at a predetermined timing and set a value obtained by adding a difference between the required power and the actual power to the present required power as the next required power.

In this way, by correcting an error of the energized power with respect to the required power by feedback control, it is possible to improve output accuracy with respect to the required power.

The above-described heater control device may stop output of power for a certain period when an integral value of the power within the certain period exceeds a required amount of heat calculated based on the required power within the certain period.

By this means, it is possible to improve output accuracy with respect to the required power without performing feedback control.

The above-described heater control device is preferably provided with a selecting unit which selects PTC elements to be put into an energized state in a descending order of power consumption of the PTC elements among the plurality of PTC elements.

Because PTC heaters with greater power consumption generate greater inrush current, by putting the PTC heaters into an energized state in a descending order of power consumption, it is possible to prevent, for example, a situation where a current value considerably exceeds a maximum allowable current value finally while the PTC heaters are sequentially put into the energized state, and reduce vertical variation (ripple) of the current value with respect to the target value.

The present invention provides a heater control method to be applied to a heater unit which includes at least two PTC heaters having PTC elements, the heater control method including a switching stage of switching between an energized state and a non-energized state of the PTC elements by turning ON and OFF for each of the PTC heaters, and a ratio controlling stage of when a required power for the heater unit is at an intermediate value of output power values defined in pattern information which associates state combination patterns of the energized state and the non-energized state of the PTC elements with the output power values supplied by the state combination patterns, controlling a ratio of the energized state to the non-energized state of the PTC elements based on a ratio of ON time to OFF time for which an average power within a certain period matches the required power.

The present invention provides a heater control program to be applied to a heater unit which includes at least two PTC heaters having PTC elements, the heater control program causing a computer to execute switching processing which switches between an energized state and a non-energized state of the PTC elements by turning ON and OFF for each of the PTC heaters, and ratio controlling processing which when a required power for the heater unit is at an intermediate value of output power values defined in pattern information which associates state combination patterns of the energized state and the non-energized state of the PTC elements with the output power values supplied by the state combination patterns, controls a ratio of the energized state to the non-energized state of the PTC elements based on a ratio of ON time to OFF time for which an average power within a certain period matches the required power.

Advantageous Effects of Invention

The present invention provides an advantage of making it possible to finely and accurately control output power values.

DESCRIPTION OF EMBODIMENTS

Hereinafter, an embodiment of a heater control device, method and program according to the present invention will be described with reference to the accompanying drawings.

{First Embodiment}

Although in this embodiment, the present invention will be described assuming that a heater unit which has three PTC heaters having PTC elements is an in-vehicle PTC heater, and a heater control device of this embodiment is applied to the in-vehicle PTC heater, the present invention is not limited thereto.

Figure 1:
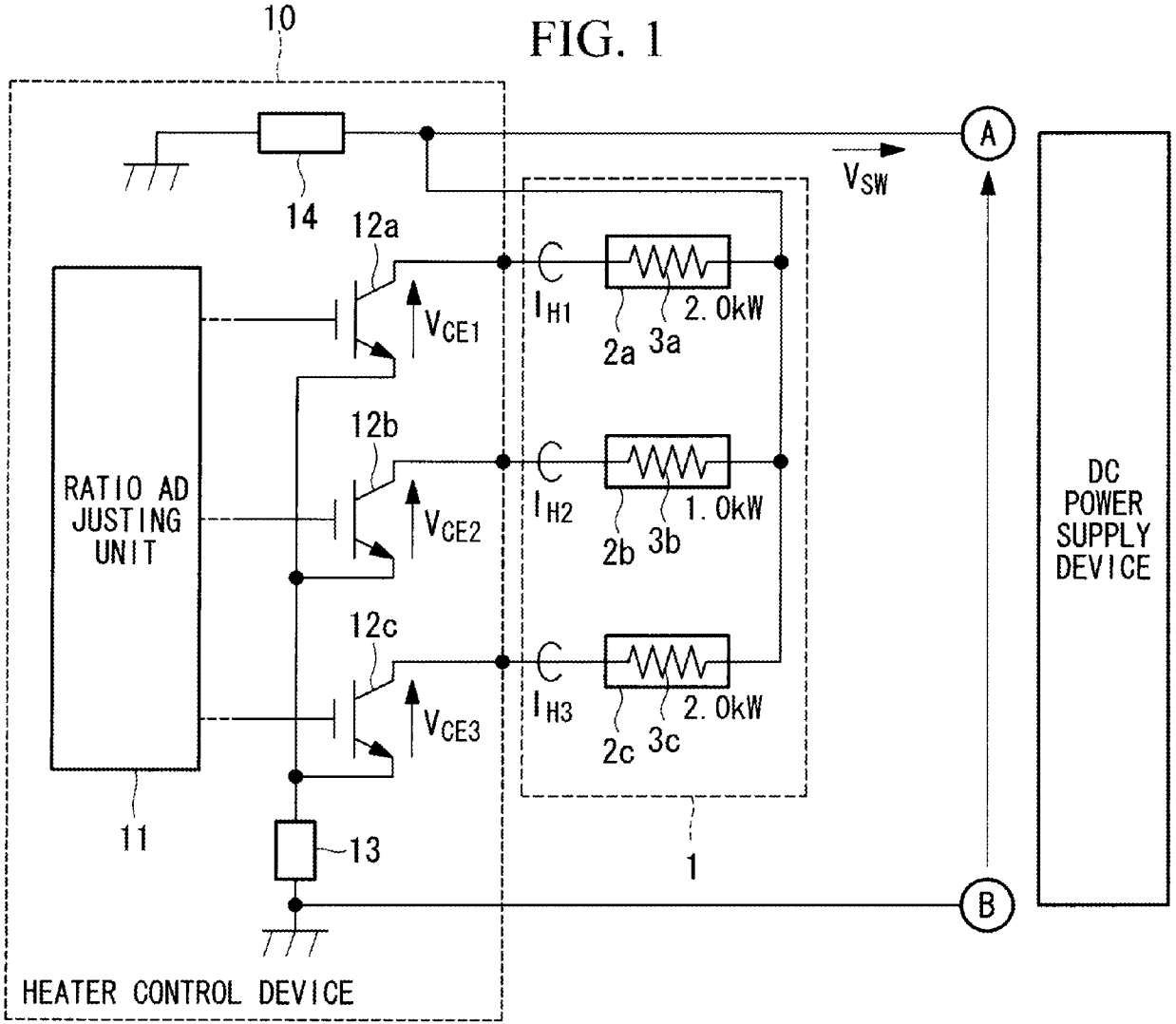
FIG. 1 is a diagram schematically showing a configuration of a heater control device according to a first embodiment of the present invention.

FIG. 1 is a diagram schematically showing a configuration of a heater control device 10 applied to an in-vehicle PTC heater 1.

In this embodiment, the in-vehicle PTC heater 1 has three PTC heaters 2*a*, 2*b* and 2*c*, which are respectively provided with PTC elements 3*a*, 3*b* and 3*c*.

Hereinafter, unless specifically described, the PTC heaters are described as PTC heaters 2, and the PTC elements are described as PTC elements 3. Although in this embodiment, it is described that three PTC heaters are provided at the in-vehicle PTC heater 1, the number of PTC heaters is not particularly limited. Further, although in this embodiment, it is described that power consumption of the PTC heaters 2*a*, 2*b* and 2*c* are respectively 2.0 kW, 1.0 kW and 2.0 kW, the power consumption of the PTC heaters is not particularly limited, and the power consumption of the PTC heaters may be all different.

As shown in FIG. 1, an upstream side of the PTC heaters 2 is connected to a terminal A which is a positive side of a DC power supply device via the heater control device 10, and a downstream side is connected to a terminal B which is a negative side of the DC power supply device via the heater control device 10.

The heater control device 10 has a ratio adjusting unit 11, switching elements (switching units) 12*a*, 12*b* and 12*c*, a current detecting unit 13 and a voltage detecting unit 14. Hereinafter, unless specifically described, the switching elements are described as switching elements 12.

The switching elements 12*a*, 12*b* and 12*c* are provided so as to respectively correspond to the PTC heaters 2*a*, 2*b* and 2*c*. Further, the switching elements 12 are connected to the ratio adjusting unit 11, and controlled to be turned ON and OFF so as to switch between energization and non-energization of the PTC heaters 2*a*, 2*b* and 2*c* based on a control signal output from the ratio adjusting unit 11.

The current detecting unit 13 measures a current value on a path on which the current detecting unit 13 is provided and outputs information of the measured current value to the ratio adjusting unit 11.

The voltage detecting unit 14 which is provided at the positive side of the DC power supply device, measures a voltage value of the heater unit 1 and outputs information of the measured voltage value to the ratio adjusting unit 11.

Figures 2, 3:
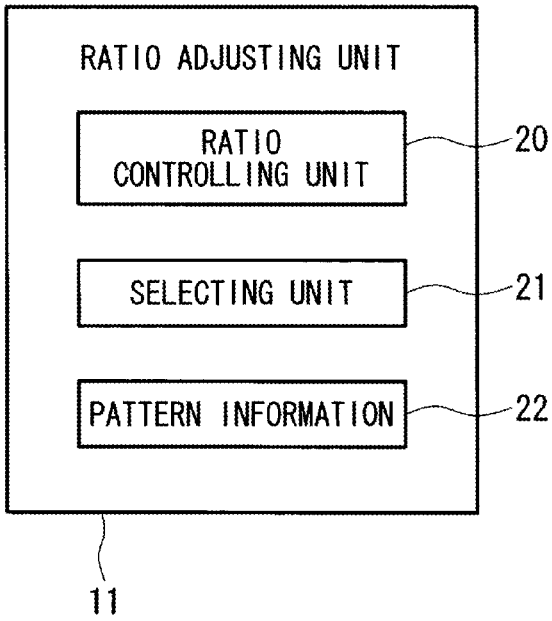
FIG. 2 is a functional block diagram showing functions of a ratio adjusting unit in an expanded manner according to the first embodiment of the present invention.
FIG. 3 shows an example of relationship between ON and OFF states of PTC heaters and output powers.

FIG. 2 is a functional block diagram showing functions of the ratio adjusting unit 11 in an expanded manner. As shown in FIG. 2, the ratio adjusting unit 11 has a ratio controlling unit 20, a selecting unit 21 and pattern information 22.

When a required power for the in-vehicle PTC heater (heater unit) 1 is at an intermediate value of output power values defined in the pattern information 22, the ratio controlling unit 20 controls a ratio between an energized state and a non-energized state of the PTC elements 3 based on a ratio of ON time to OFF time for which an average power within a certain period matches the required power.

The ratio controlling unit 20 sets a switching period of the switching elements 12 to be longer than a period during which a switching loss caused by switching between energization and non-energization of the switching elements 12 is equal to or less than an allowable loss, and smaller than a period determined by overall heat capacity of the in-vehicle PTC heater while satisfying a condition that a difference between a water temperature of the PTC heaters 2 and a target temperature is equal to or less than a predetermined temperature difference and controls the switching elements based on this switching period.

Further, when the required power for the in-vehicle PTC heater 1 is an output power value defined in the pattern information 22, the ratio controlling unit 20 controls the energized state and the non-energized state of the PTC elements 3 based on a state combination pattern (described latter in details) of ON and OFF of the PTC heaters 2 corresponding to the output power value of the pattern information 22.

When the plurality of PTC heaters 2 are put into an energized state, the selecting unit 21 selects the PTC elements 3 to be put into the energized state in a descending order of power consumption of the PTC elements 3 among the plurality of PTC elements 3. Because PTC heaters with greater power consumption generate greater inrush current, by putting the PTC heaters into an energized state in a descending order of power consumption, it is possible to prevent, for example, a situation where a current value considerably exceeds a maximum allowable current value finally while the PTC heaters are sequentially put into the energized state, and reduce vertical variation (ripple) of the current value.

The pattern information 22 associates state combination patterns of the energized state and the non-energized state of the PTC elements 3 with output power values supplied by the state combination patterns. Specifically, as shown in FIG. 3, state combination patterns of ON and OFF of the PTC heaters 2*a*, 2*b* and 2*c* are associated with information of output powers corresponding to the state combination patterns. FIG. 3 indicates an ON state of the PTC heaters 2 with a black circle mark, and an OFF state with a white circle mark, and, for example, shows that output power of 1.0 kW can be supplied by putting the PTC heater 2*b* into an ON state and putting the PTC heaters 2*a* and 2*c* into an OFF state (pattern 1). The state combination patterns are numbered serially for convenience of explanation.

Figure 4:
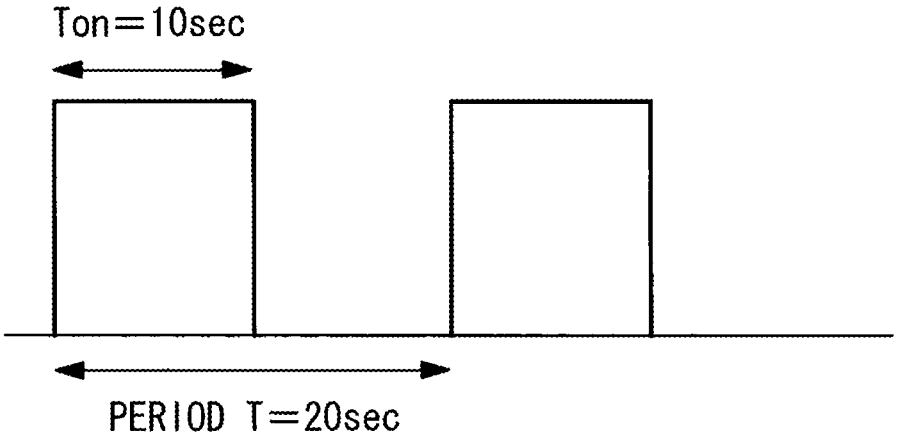
FIG. 4 shows an example where a ratio controlling unit controls a duration for energizing the PTC heaters.
Figure 5:
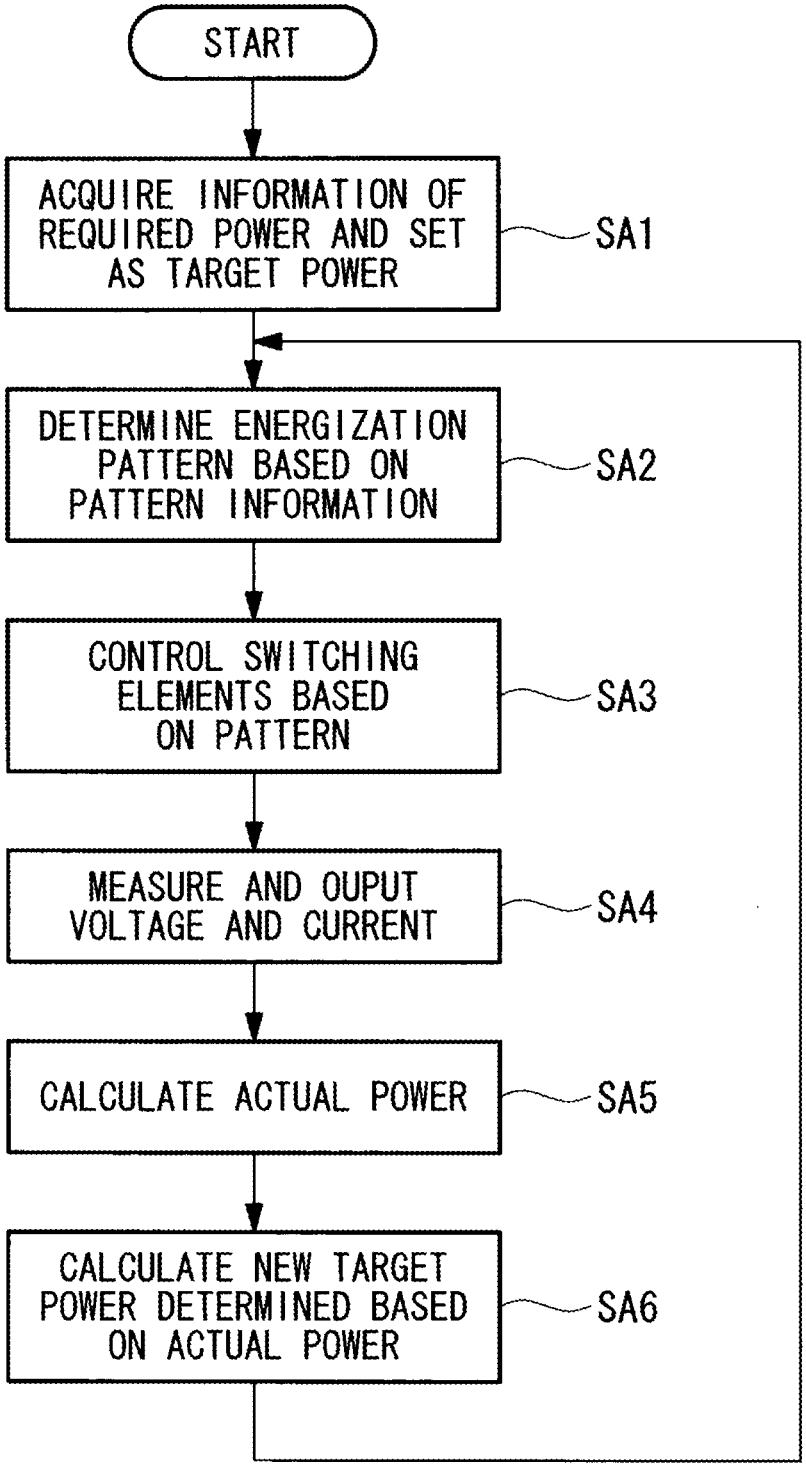
FIG. 5 shows a operation flow of the heater control device according to the first embodiment of the present invention.

A method of controlling the ratio controlling unit 20, for example, when the required power is 0.5 (kW) will be described below. Based on FIG. 3, power of 0.5 (kW) is power of an intermediate value between a pattern 0 (0 (kW)) where all the PTC heaters are in an OFF state and a pattern 1 (1 (kW)) where the PTC heater 2*b* is in an ON state and the PTC heaters 2*a* and 2*c* are in an OFF state. Further, because when the pattern 1 is 100% in an ON state, power of 1 (kW) is output, it is possible to output power of 0.5 (kW) by maintaining the ON state for a period of 50% of a period T. That is, for example, when the period T of the PTC heater 2*b* is 20 (seconds), a ON state time Ton is made 10 (seconds) and an OFF state time Toff is made 10 (seconds) (see FIG. 4).

In this way, when the required power is at an intermediate value of the output power values associated in the pattern information 22, the ratio controlling unit 20 selects a state combination pattern with which power exceeding the required power can be supplied and controls a ratio of the ON time to the OFF time of the selected pattern, thereby adjusting a ratio between the energized state and the non-energized state of the PTC elements 3 so that an average power within a certain period matches the required power.

Next, the above-described control method in the heater control device 10 will be described using FIGS. 1 to 5.

The heater control device 10 sets information of an acquired required power value (for example, 2.5 kW) as a target power value at time T(0) (step SA1). Based on the pattern information 22, the ratio adjusting unit 20 determines a state combination pattern of an ON state and an OFF state of the PTC heaters 2 with which power of the target power value can be output (step SA2). The heater control device 10 controls an ON state and an OFF state of the switching elements 12 based on the determined state combination pattern to control energization and non-energization of the PTC elements 3 (step SA3).

When the target power value is an output power value indicated in the pattern information 22, the PTC heaters 2 are controlled to be turned ON and OFF based on the state combination pattern of the ON and OFF states associated with the output power value. Alternatively, when the target power value is at an intermediate value of the output power values indicated in the pattern information 22, a pattern with which a power value closest to the target power can be supplied is selected from the patterns with which power exceeding the target power can be output, and a ratio of ON time of the PTC heaters 2, which is turned on in accordance with the selected pattern, to OFF time is adjusted for control.

For example, in order to output a required power value of 2.5 kW, a pattern 3 which is a state combination pattern that can supply 2.5 kW and that can output a power value (3.0 kW) closest to 2.5 kW is selected. That is, a combination pattern where the PTC heaters 2*a* and 2*b* are in an ON state and the PTC heater 2*c* is in an OFF state is selected based on FIG. 3. Further, because the PTC heaters 2 are sequentially put into an ON state in a descending order of power, after the PTC heater 2*a* is put into an ON state for 100% period of one period T, the PTC heater 2*b* is put into an ON state. At this time, when the PTC heater 2*b* is put into an ON state for 100% period of one period T, because power of 1 (kW) is output, a ratio is adjusted so that the ON state time Ton is made 50% to control the PTC heater 2*b* to output power of 50% of 1 kW. By this means, because the PTC heater 2*a* outputs 2 kW and the PTC heater 2*b* outputs 0.5 kW, the total power of 2.5 kW can be output.

The current detecting unit 13 measures a current value, the voltage detecting unit 14 measures a voltage value, and information of the current value and the voltage value is output to the heater control device 10 respectively (step SA4). Based on the information of the acquired current value and voltage value, an actual power is calculated (step SA5). A value obtained by multiplying a difference between the calculated actual power and a required power value at a present time T(n) by a coefficient K (K is between 0 and 1) and adding a target power value at the present time T(n) is set as a target power value for the next time T(n+1) (step SA6). After the target power value at the next time T(n+1) is calculated, the method returns to the step SA2 and processing is repeated.

It is also possible to configure the heater control device 10 according to the above-described embodiment to process all or part of the above processing using separate software. In this case, the heater control device 10 has a CPU, a main memory such as a RAM, and a computer readable recording medium in which a program for implementing all or part of the above processing is recorded. The CPU reads the program recorded in the recording medium and executes processing and arithmetic processing of information, thereby realizing the similar processing to that performed by the above-described heater control device.

Here, the computer readable recording medium includes a magnetic disc, a magnetic optical disc, a CD-ROM, a DVD-ROM, a semiconductor memory, or the like. It is further possible to distribute this computer program to a computer using a communication line and make the computer to which the computer program is distributed execute the program.

As described above, according to the heater control device 10, the method and the program according to this embodiment, energization and non-energization of the PTC elements 3 are switched by turning ON and OFF the switching elements 12 provided so as to correspond to the PTC heaters 2 based on the pattern information 22 in which state combination patterns of the energized state and the non-energized state of the PTC heaters 2 and the output power values supplied by the state combination patterns are defined, and power that satisfies the required power is output. Further, when the required power is at an intermediate value of the output power values defined in the pattern information 22, because a ratio of the energized state to the non-energized state of the PTC elements 3 is controlled based on a ratio of ON time to OFF time for which an average power within a certain period matches the required power, the power value output from the in-vehicle PTC heater 1 can be controlled in a non-stepwise manner, so that it is possible to realize fine control. Further, even when there is an error in an energized power due to variation of the PTC elements 3 or even when a resistive value of the element varies over time due to a temperature, which changes a current and as a result, degrades accuracy of realizing an output power, it is possible to improve output accuracy to satisfy the required power by performing correction by feedback control.

Modification

Figure 6:
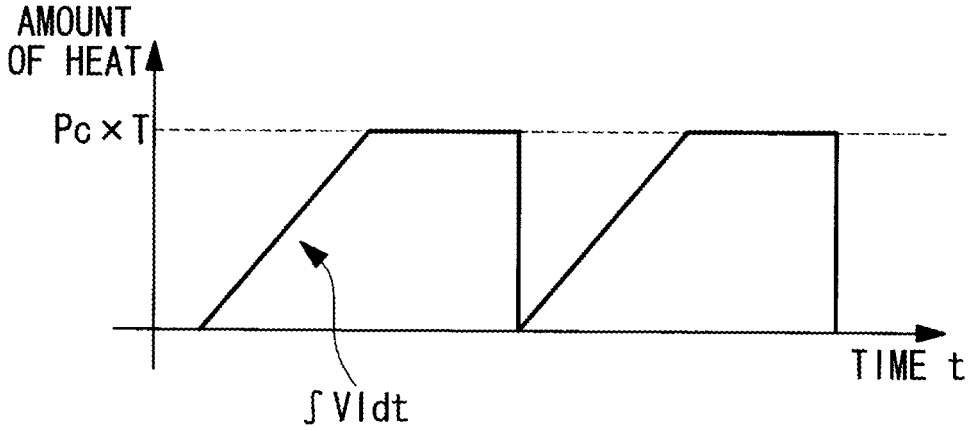
FIG. 6 illustrates a modification of the first embodiment of the present invention.

Although in this embodiment, the heater control device 10 is configured to perform control to satisfy the required power by correcting an error in the energized power caused due to variation of the PTC elements 3 using the feedback control, the control method for satisfying the required power is not limited thereto. For example, it is also possible to perform control by calculating an amount of heat Pc (joule (J)) required within a certain period (for example, T seconds) for the required power in advance, and, when an integral value between a current value and a voltage value within the certain period exceeds the above amount of heat, stopping output during the segment. Specifically, as shown in FIG. 6, an instantaneous power P calculated based on a product of the current value I detected by the current detecting unit 13 and the voltage value V detected by the voltage detecting unit 14 is time integrated, and energization is stopped at a time when the amount of heat reaches a required amount of heat Pc×T calculated in advance, so that the total amount of heat required for one period is controlled. In this way, by sequentially integrating the power and maintaining a constant amount of heat for each segment, it is possible to satisfy the required power without performing the above-described feedback control.

REFERENCE SIGNS LIST

2, 2*a*, 2*b*, 2*c* PTC heater
3, 3*a*, 3*b*, 3*c* PTC element
10 heater control device
11 ratio adjusting unit
12, 12*a*, 12*b*, 12*c* switching element
20 ratio controlling unit
21 selecting unit
22 pattern information

The invention claimed is:

1. A heater control device to be applied to a heater unit provided with a plurality of PTC heaters each of which has a predetermined power consumption value, the heater control device comprising:

a plurality of switching units each of which is provided corresponding to each of the plurality of PTC heaters and allows each of the plurality of PTC heaters to be put into an energized state or a non-energized state by a switching operation, which makes each of the plurality of switching units turn ON or OFF;

a storing unit that stores each of a plurality of power values, which can be output by combining the plurality of PTC heaters, in association with each of a plurality of sets of state combination pattern information which indicates that each of the plurality of PTC heater is a PTC heater to be put into the energized state or a PTC heater to be put into the non-energized state when outputting each of the plurality of power values; and a ratio controlling unit that selects one of the plurality of sets of state combination pattern information in accordance with a target power value in which the heater unit outputs, wherein the ratio controlling unit, when the target power value is between the plurality of power values that are stored, selects a state combination pattern information, among the plurality of sets of state combination pattern information, which is associated with a power value which is exceeding the target power value and is closest to the target power value, and wherein the ratio controlling unit allows time for turning ON a switching unit corresponding to an energization object-PTC heater, among the plurality of PTC heaters, to change in accordance with the target power value, the energization object-PTC heater being indicated as a PTC heater to be put into the energized state in the state combination pattern information which is selected.

2. The heater control device according to claim 1, wherein the ratio controlling unit sets a period of the switching operation so as to be longer than a period during which a switching loss that is a power loss caused by the switching operation is equal to or less than a predetermined allowable loss and so as to be shorter than a period determined by overall heat capacity of the heater unit while satisfying a condition that a difference between a temperature of water heated by the plurality of PTC heaters and a target temperature is equal to or less than a predetermined temperature difference, the temperature of water being controlled by the heater unit.

3. The heater control device according to claim 1, comprising:

a current detecting unit that measures a current value for the heater unit; and a voltage detecting unit that measures a voltage value of the heater unit, wherein the ratio controlling unit calculates an actual power value which is a power value output by the heater unit on the basis of the current value measure by the current detecting unit and the voltage value measured by the voltage detecting unit, and wherein the ratio controlling unit sets a value, as a new target power value, in which a value calculated based on a difference between the actual power value and the target power value is added to the target power value.

4. The heater control device according to claim 1, comprising:

a current detecting unit that measures a current value for the heater unit; and a voltage detecting unit that measures a voltage value of the heater unit, wherein the ratio controlling unit calculates an integral value of power which the heater unit outputs within a certain period on the basis of the current value measure by the current detecting unit and the voltage value measured by the voltage detecting unit, and wherein when the integral value of power exceeds a required amount of heat calculated based on the target power value, the ratio controlling unit allows a switching unit corresponding to the energization object-PTC heater to turn OFF for the certain period.

5. The heater control device according to claim 1, comprising a selecting unit, when there are multiple energization object-PTC heaters, that selects PTC heaters to be put into the energized state in a descending order of power consumption values of the PTC heaters among the energization object-PTC heaters.

6. A heater control method in a heater control device which is applied to a heater unit provided with a plurality of PTC heaters each of which has a predetermined power consumption value, wherein the heater control device includes a plurality of switching units each of which is provided corresponding to each of the plurality of PTC heaters and allows each of the plurality of PTC heaters to be put into an energized state or a non-energized state by a switching operation, which makes each of the plurality of switching units turn ON or OFF and a storing unit that stores each of a plurality of power values, which can be output by combining the plurality of PTC heaters, in association with each of a plurality of sets of state combination pattern information which indicates the each of the plurality of PTC heaters is a PTC heater to be put into the energized state or a PTC heater to be put into the non-energized state when outputting each of the plurality of power values, and the heater control method comprising:

selecting, when a target power value in which the heater unit output is between the plurality of power values that are stored, a state combination pattern information, among the plurality of sets of state combination pattern information, which is associated with a power value which is exceeding the target power value and is closest to the target power value, and allowing time for turning ON a switching unit corresponding to an energization object-PTC heater, among the plurality of PTC heaters, to change in accordance with the target power value, the energization object-PTC heater being indicated as a PTC heater to be put into the energized state in the state combination pattern information which is selected.

7. A non-transitory computer-readable recording medium in which a heater control program is stored, the heater control program causing a heater control device which is applied to a heater unit provided with a plurality of PTC heaters each of which has a predetermined power consumption value to execute functions, wherein the heater control device includes a plurality of switching units each of which is provided corresponding to each of the plurality of PTC heaters and allows each of the plurality of PTC heaters to be put into an energized state or a non-energized state by a switching operation, which makes each of the plurality of switching units turn ON or OFF and a storing unit that stores each of a plurality of power values, which can be output by combining the plurality of PTC heaters, in association with each of a plurality of sets of state combination pattern information which indicates that each of the plurality of PTC heaters is a PTC heater to be put into the energized state or a PTC heater to be put into the non-energized state when outputting each of the plurality of power values, and the functions comprise:

selecting, when a target power value in which the heater unit output is between the plurality of power values that are stored, a state combination pattern information, among the plurality of sets of state combination pattern information, which is associated with a power value which is exceeding the target power value and is closest to the target power value, and allowing time for turning ON a switching unit corresponding to an energization object-PTC heater, among the plurality of PTC heaters, to change in accordance with the target power value, the energization object-PTC heater being indicated as a PTC heater to be put into the energized state in the state combination pattern information which is selected.

* * * * *